US009969537B2

(12) United States Patent
Okubo et al.

(10) Patent No.: US 9,969,537 B2
(45) Date of Patent: May 15, 2018

(54) EASILY OPENABLE CONTAINER LID

(71) Applicant: NIPPON CLOSURES CO., LTD., Tokyo (JP)

(72) Inventors: Yusuke Okubo, Kanagawa (JP); Katsuhito Ichimura, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 97 days.

(21) Appl. No.: 14/912,716

(22) PCT Filed: Aug. 8, 2014

(86) PCT No.: PCT/JP2014/070984
§ 371 (c)(1),
(2) Date: Feb. 18, 2016

(87) PCT Pub. No.: WO2015/025737
PCT Pub. Date: Feb. 26, 2015

(65) Prior Publication Data

US 2016/0207671 A1 Jul. 21, 2016

(30) Foreign Application Priority Data

Aug. 22, 2013 (JP) ..... 2013-172342

(51) Int. Cl.
*B65D 41/42* (2006.01)
*B65D 43/26* (2006.01)
*B65D 53/02* (2006.01)

(52) U.S. Cl.
CPC ..... *B65D 43/26* (2013.01); *B65D 41/42* (2013.01); *B65D 53/02* (2013.01)

(58) Field of Classification Search
CPC ..... B65D 43/26; B65D 53/02; B65D 41/42
(Continued)

(56) References Cited

U.S. PATENT DOCUMENTS 3,974,931 A * 8/1976 Moller ..... B65D 41/42 215/254
4,003,488 A 1/1977 Moller
(Continued)

FOREIGN PATENT DOCUMENTS

JP 61-80256 5/1986
JP 61-80259 5/1986
(Continued)

OTHER PUBLICATIONS

European Search Report issued in Patent Application No. 14837271.7, dated Mar. 20, 2017.
(Continued)

*Primary Examiner* — James N Smalley
(74) *Attorney, Agent, or Firm* — Greenblum & Bernstein, P.L.C.

(57) ABSTRACT

An easily openable container lid has a shell and a liner embossed on the inner surface of a top panel wall and a pair of scores formed in the shell. The liner is adhered over the entire surface thereof to the inner surface of the top panel wall. At least second portions of the pair of scores are formed by forming grooves on the inner surface side of the shell, and are extended along the peripheral edge of the liner radially outwardly of the liner. Moreover, the liner has a thin-walled central section and a thick-walled peripheral edge section, and is configured to have a downwardly protruding outer sealing ridge formed in a radially outward region of the thick-walled peripheral edge section. The thickness of the thin-walled central section and the thickness of the thick-walled peripheral edge section are set within required ranges.

6 Claims, 4 Drawing Sheets

(58) Field of Classification Search
USPC ..... 215/254–256
See application file for complete search history.

(56) References Cited

U.S. PATENT DOCUMENTS

| | | | | |
|---|---|---|---|---|
| 4,605,137 | A | 8/1986 | Taragna et al. | |
| 4,768,667 | A * | 9/1988 | Magnusson | B65D 41/40 215/255 |
| 5,145,084 | A * | 9/1992 | Murayama | B65D 41/44 215/255 |
| 5,224,616 | A * | 7/1993 | Crisci | B65D 41/485 215/254 |

FOREIGN PATENT DOCUMENTS

| | | |
|---|---|---|
| JP | 62-38856 | 3/1987 |
| JP | 10-024955 | 1/1998 |
| JP | 2003-34345 | 2/2003 |
| JP | 2008-174266 | 7/2008 |
| JP | 2011-173594 | 9/2011 |

OTHER PUBLICATIONS

International Search Report issued in PCT/JP2014/070984, dated Nov. 18, 2014.
Chinese Office Action issued in Counterpart Patent Appl. No. 201480046525.7, dated Oct. 19, 2016, along with an english translation thereof.

* cited by examiner

EASILY OPENABLE CONTAINER LID

TECHNICAL FIELD

This invention relates to an easily openable container lid for a container having a cylindrical mouth-neck section having an annular locking ridge formed in an upper end part of the outer peripheral surface thereof, or a container accommodating, in particular, but not limited to, a gas-containing liquid; and more particularly, an easily openable container lid composed of a shell including a circular top panel wall, a skirt wall extending from the peripheral edge of the top panel wall arcuately in a radially outward and downward direction and then extending downwardly vertically, in a vertical sectional view, and a gripping piece extending out from the lower end of the skirt wall, and a synthetic resin liner formed by embossing a synthetic resin material on the inner surface of the top panel wall of the shell.

BACKGROUND ART

Patent Documents 1 and 2 to be indicated below each disclose an easily openable container lid for a container accommodating a gas-containing liquid, in particular, accordingly a container whose interior is brought to a positive pressure after its mouth-neck section is mounted with a container lid for sealing, the easily openable container lid being composed of a shell which includes a circular top panel wall, a skirt wall extending from the peripheral edge of the top panel wall arcuately in a radially outward and downward direction and then extending downwardly vertically, in a vertical sectional view, and a gripping piece extending out from the lower end of the skirt wall, and a disk-shaped synthetic resin liner disposed on the inner surface of the top panel wall of the shell. The top panel wall, the skirt wall, and at least the base of the gripping piece, of the shell are formed from a metallic sheet such as an aluminum-based alloy sheet. The shell is further formed with a pair of scores having first portions extending upwardly on the skirt wall from both sides of the gripping piece, and second portions continuous with the first portions and extending at the peripheral edge of the top panel wall. The liner is formed by embossing a synthetic resin material on the inner surface of the top panel wall of the shell. The second portions of the pair of scores are located radially inwardly of the outer peripheral edge of the liner. In order to avoid the inhibition of breakage because of the presence of the liner in breaking the second portions of the pair of scores, the liner is brought into a state of non-adhesion or weak adhesion to the inner surface of the top panel wall of the shell at least in a region where the second portions of the sores extend.

Patent Document 3 indicated below discloses an easily openable container lid for a container accommodating a liquid in a heated state, accordingly, a container whose interior is brought to a negative pressure after its mouth-neck section is mounted with and closely contacted with a container lid, the easily openable container lid which has an annular groove formed in a thick-walled peripheral end section of a liner, and in which opposite-side parts demarcated with such a groove are rendered deformable without interfering with each other, so that even when an impact is applied to the container lid mounted on the mouth-neck section of the container, damage to the sealing of the mouth-neck section is avoided if possible.

PRIOR ART DOCUMENTS

Patent Documents

Patent Document 1: JP-A-2008-174266
Patent Document 2: JP-A-2011-173594
Patent Document 3: JP-A-2003-34345

SUMMARY OF THE INVENTION

Problems to be Solved by the Invention

In the easily openable container lid of the type disclosed in Patent Documents 1 and 2, it is necessary that in a specific region, the liner be locally brought to the state of non-adhesion or weak adhesion to the inner surface of the top panel wall. For this purpose, it is necessary, for example, to dispose a film, which has non-adhesive or weakly adhesive properties for the liner, locally on the inner surface of the top panel wall in the specific region. These necessities render a manufacturing process for the easily openable container lid somewhat complicated, thus increasing the cost of manufacturing. Since the liner is in the state of non-adhesion or weak adhesion to the inner surface of the top panel wall in the specific region, moreover, the peripheral edge section of the line is not smoothly separated from an embossing tool having embossed the liner, when the embossing tool is to be separated from the liner. As a result, the liner tends to be deformed or damaged. To avoid this tendency, there is need to make the central section and peripheral edge section of the liner relatively thick-walled, thereby increasing the rigidity of the liner. Thus, the amount of the synthetic resin material necessary for formation of the liner is increased and, in this connection as well, the manufacturing cost is increased.

In the easily openable container lid disclosed in Patent Document 3, on the other hand, the groove should be formed, and both sides of the groove should be made deformable without interfering with each other. For this purpose, it is generally necessary to thicken the peripheral edge section of the liner considerably, thus increasing the amount of the synthetic resin material needed for formation of the liner, thereby leading to an increase in the manufacturing cost. The properties of the liner of the easily openable container lid disclosed in Patent Document 3, namely, the properties that both sides of the groove are deformable without interfering with each other, are effective only when the container lid is applied to a container whose interior is brought to a negative pressure after its mouth-neck section is mounted with and closely contacted with a container lid. The easily openable container lid disclosed in Patent Document 3 is thus unsuitable for a container whose interior is brought to a positive pressure after its mouth-neck section is mounted with and sealed with a container lid.

The present invention has been accomplished in the light of the above facts. Its main technical challenge is to provide a novel and improved easily openable container lid in which a liner when embossed is neither deformed nor damaged, damage to the seal of a mouth-neck section is avoided, if possible, even when an impact is applied to the container lid and, nonetheless, the manufacturing cost can be sufficiently reduced.

Means for Solving the Problems

Upon in-depth studies and experiments, the present inventors have found that the above main technical challenge can be solved by (1) adhering a liner over its entire surface to the inner surface of a top panel wall, (2) forming grooves on the inner surface side of a shell to form at least second portions of a pair of scores, and extending the second portions radially outwardly of the liner along the peripheral edge of the liner, and (3) forming the liner so as to have a thin-walled central section and a thick-walled peripheral edge section, and to have a downwardly protruding outer sealing ridge formed in a radially outward region of the thick-walled peripheral edge section, in such a manner that the thickness of the thin-walled central section and the thickness of the thick-walled peripheral edge section are set within required ranges.

That is, according to the present invention, there is provided, as an easily openable container lid for solving the above main technical challenge, an easily openable container lid for a container having a cylindrical mouth-neck section having an annular locking ridge formed in an upper end part of an outer peripheral surface thereof, the easily openable container lid being composed of a shell including a circular top panel wall, a skirt wall extending from the peripheral edge of the top panel wall arcuately in a radially outward and downward direction and then extending downwardly vertically, in a vertical sectional view, and a gripping piece extending out from the lower end of the skirt wall, wherein the top panel wall, the skirt wall, and at least the base of the gripping piece are integrally formed from a metallic sheet, and the shell is formed with a pair of scores having first portions extending upwardly on the skirt wall from both sides of the gripping piece, and second portions continuous with the first portions and extending arcuately at the upper end of the skirt wall or the peripheral edge of the top panel wall, and a disk-shaped synthetic resin liner formed by embossing a synthetic resin material on the inner surface of the top panel wall of the shell, wherein the liner is adhered over the entire surface thereof to the inner surface of the top panel wall, at least the second portions of the pair of scores are formed by forming grooves on the inner surface side of the shell, and are extended along the peripheral edge of the liner radially outwardly of the liner, and the liner has a thin-walled central section and a thick-walled peripheral edge section, and has a downwardly protruding outer ridge formed in a radially outward region of the thick-walled peripheral edge section, the thin-walled central section of the liner has a thickness of 0.15 to 0.30 mm, and the thick-walled peripheral edge section has a thickness of 0.45 to 0.75 mm.

The matter specifying the present invention, "the thin-walled central section of the liner has a thickness of 0.15 to 0.30 mm," specifies that substantially the entire region of the thin-walled central section of the liner has a thickness of 0.15 to 0.30 mm, and implies that in the thin-walled central section of the liner, there may be a site, where the thickness locally exceeds a thickness of 0.15 to 0.30 mm, in order to indicate a predetermined mark, for example.

Preferably, the outer ridge protrudes 1.00 to 1.40 mm from the lower surface of the thick-walled peripheral edge section. Preferably, a downwardly protruding inner ridge is formed in a radially inward region of the thick-walled peripheral edge section of the liner, and the inner ridge protrudes 0.50 to 0.70 mm from the lower surface of the thick-walled peripheral edge section. In preferred embodiments, a gas-containing liquid is accommodated within the container, the interior of the container is brought to a positive pressure after the easily openable container lid is mounted on the mouth-neck section of the container to seal the mouth-neck section, and the top panel wall of the shell is flat. Advantageously, the top panel wall, the skirt wall, and at least the base of the gripping piece, of the shell are formed from an aluminum-based alloy sheet having a thickness of 0.17 to 0.19 mm; the residual thickness of a breakage starting end section of the first portions of the pair of scores is 150 to 170 μm, the residual thickness of the remainder of the first portions is 135 to 155 μm, and the residual thickness of the second portions is 105 to 125 μm.

Effects of the Invention

In the easily openable container lid of the present invention, the liner is adhered over the entire surface thereof to the inner surface of the top panel wall of the shell. Thus, it is unnecessary to dispose a film, which has the property of not adhering or weakly adhering to the liner in a specific region, locally on the inner surface of the top panel wall. Consequently, an increase in the manufacturing cost can be curbed. Since the liner is adhered over the entire surface thereof to the inner surface of the top panel wall of the shell, moreover, the embossing tool can be smoothly separated from the peripheral edge section of the liner, without the need to make the central section and peripheral edge section of the liner relatively thick-walled, thereby increasing the rigidity of the liner. Based on these facts as well, an increase in the manufacturing cost can be avoided. In addition, the wall thicknesses of the central section and peripheral edge section of the liner are set in appropriate ranges. Thus, the flow of the synthetic resin material is not impeded during the embossing of the liner (if the thickness of the thin-walled central section of the liner is rendered excessively small, the synthetic resin material does not satisfactorily flow to the peripheral edge section during embossing of the liner, thus posing difficulty with the embossing of the liner). When the easily openable container lid with such features is applied to a container whose interior is brought to a positive pressure after the mouth-neck section of the container is mounted with the container lid to seal the mouth-neck section, an injury to the seal of the mouth-neck section is avoided, where possible, even upon application of an impact to the container lid.

MODE FOR CARRYING OUT THE INVENTION

The present invention will now be described in further detail by reference to the accompanying drawings showing a preferred embodiment of an easily openable container lid configured in accordance with the present invention.

Figure 1:
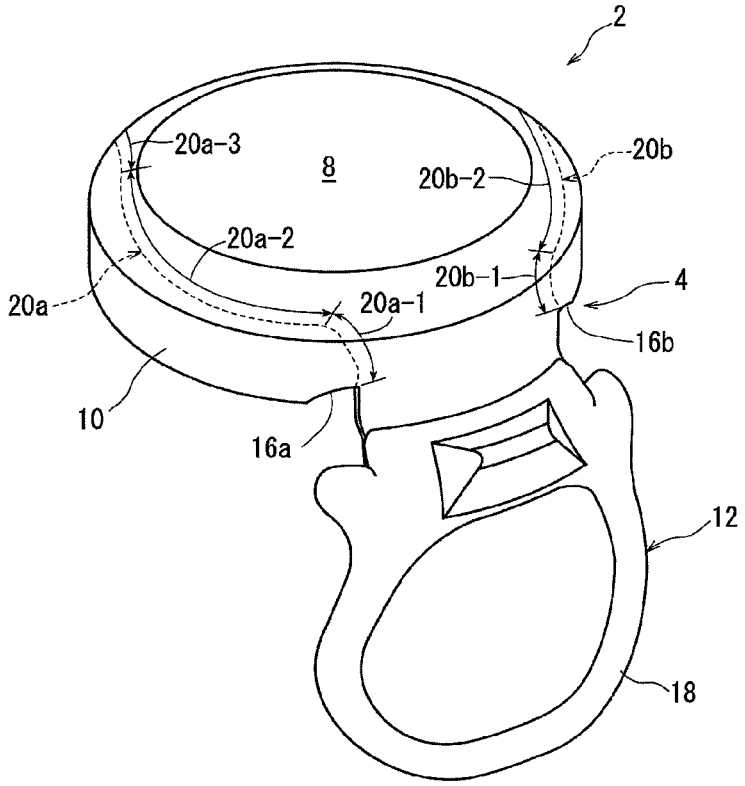
[FIG. 1] is a perspective view showing a preferred embodiment of a container lid configured in accordance with the present invention.
Figure 2:
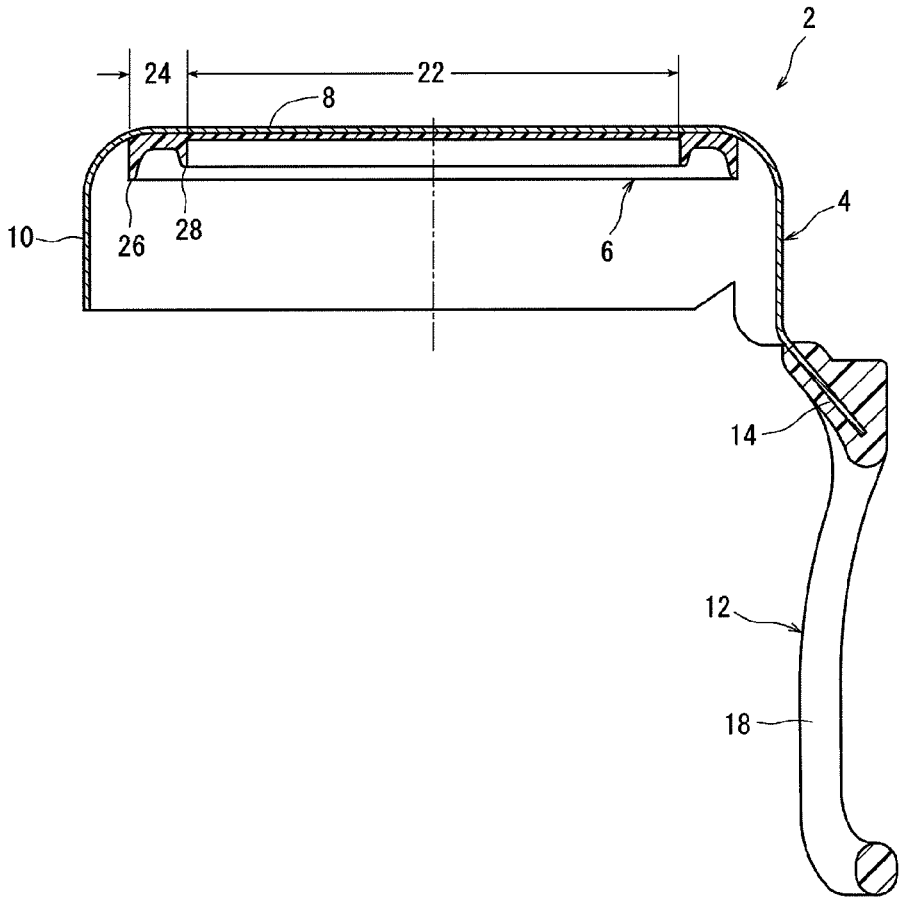
[FIG. 2] is a sectional view of the container lid shown in FIG. 1.

With reference to FIGS. 1 and 2, a container lid, entirely indicated at 2, is composed of a shell 4 and a liner 6.

The shell 2 has a circular top panel wall 8, a skirt wall 10 extending downwardly from the peripheral edge of the top panel wall 8, and a gripping piece 12 extending out from the lower end of the skirt wall 10. It is advantageous that the top panel wall 8 be flat all over. The skirt wall 10 extends from the peripheral edge of the top panel wall 8 arcuately in a radially outward and downward direction and then substantially vertically in a downward direction, in FIG. 2 (a vertical sectional view). In the illustrated embodiment, as will be clearly understood by referring to FIG. 2, the top panel wall 8, the skirt wall 10, and the base 14 of the gripping piece 12 are integrally formed by performing suitable processing, such as punching or draw forming, of a metal sheet, preferably an aluminum-based alloy having a thickness of the order of 0.17 to 0.19 mm. A surface of the metal sheet for formation of the shell 4, namely, a surface corresponding to the inner surface of the shell 4, is coated with an adhesive paint for adhering the liner 6, which is formed by embossing a synthetic resin material on the top panel wall 8 of the shell 4, to the inner surface of the shell 4 (however, a non-adhesive paint for bringing the inner surface of the shell 4 and the liner 6 into local non-adhesion need not be locally coated on the adhesive paint). The other surface of the metal sheet, namely, the surface corresponding to the outer surface of the shell 4, can be coated with a suitable protective paint, and can be provided with a required print.

On both sides of the base 14 of the gripping piece 12, notches 16*a* and 16*b* are formed at the lower end of the skirt wall 10. The gripping piece 12 is composed of the base 14 and a ring-shaped section 18 coupled to the base 14. The ring-shaped section 18 of the gripping piece 12 can be molded and, simultaneously, coupled to the base 14 by injection molding or compression molding of a suitable synthetic resin material, such as polypropylene or polyethylene, with the use of the base 14 of the gripping piece 12 as a so-called core. If desired, the whole of the gripping piece 12 can be formed integrally from a metal sheet together with the top panel wall 8 and the skirt wall 10.

Figure 3:
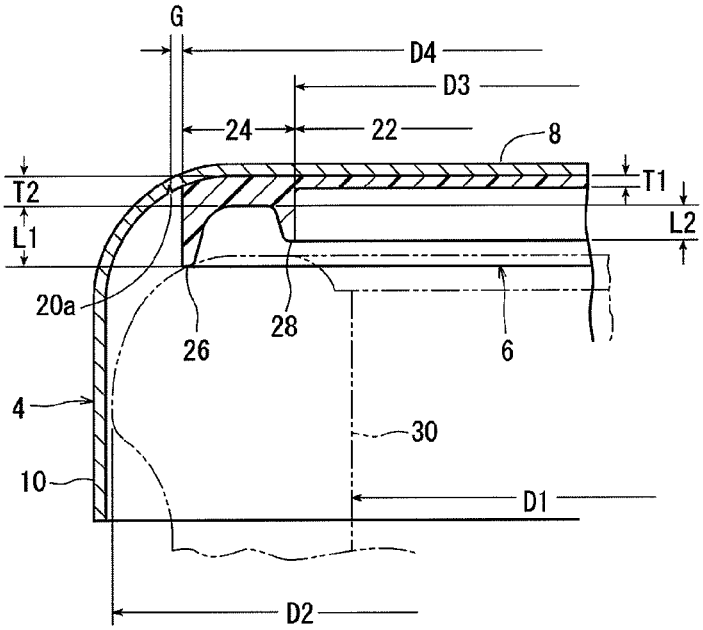
[FIG. 3] is a partial sectional view showing a score formed in a shell of the container lid shown in FIG. 1.

By further reference to FIG. 3 along with FIGS. 1 and 2, the shell 4 is further formed with a pair of scores 20*a* and 20*b*. It is important for the pair of scores 20*a* and 20*b* to have first portions 20*a*-1 and 20*b*-1 extending upwardly on the skirt wall 10 from both sides of the gripping piece 12 in the skirt wall 10, more detailedly, from the notches 16*a* and 16*b*, and second portions 20*a*-2 and 20*b*-2 extending arcuately at the upper end of the skirt wall 10. If desired, the second portions 20*a*-2 and 20*b*-2 can be configured to extend arcuately at the peripheral edge of the top panel wall 8. In the illustrated embodiment, the pair of scores 20*a* and 20*b* also includes the above second portions 20*a*-2 and 20*b*-2 and extending-out end portions 20*a*-3 and 20*b*-3 further extending downward on the skirt wall 10 (the third portion 20*b*-3 of the scores 20*b* is not illustrated). It is important that at least the second portions 20*a*-2 and 20*b*-2 of the pair of scores 20*a* and 20*b* be formed by forming grooves in the inner surface, rather than in the outer surface, of the shell 4, in order that the breakage of the pair of scores 20*a* and 20*b* is avoided during shaping, further detailedly during draw forming, of the shell 4. In the illustrated embodiment, the whole of the pair of scores 20*a* and 20*b* is formed by forming grooves in the inner surface of the shell 4. If the top panel wall 8, the skirt wall 10 and the base 14 of the gripping piece 12 in the shell 4 are formed of an aluminum-based alloy with a thickness of the order of 0.17 to 0.19 mm, it is preferred that the residual thickness of the breakage starting end section of the first portions 20*a*-1 and 20*b*-1 of the pair of scores 20*a* and 20*b*, namely, the residual thickness of a part in a range of about 1 mm from the notches 16*a* and 16*b*, be of the order of 150 to 170 μm, the residual thickness of the remainder of the first portions 20*a*-1 and 20*b*-1 be of the order of 135 to 155 μm, and the residual thickness of the second portions 20*a*-2 and 20*b*-2 and the extending-out end portions 20*a*-3 and 20*b*-3 be of the order of 105 to 125 μm, from the aspects of the avoidance of accidental breakage of the pair of scores 20*a* and 20*b* and the breakage properties at the time of opening.

With further reference to FIGS. 2 and 3, the liner 6 is formed by supplying a suitable synthetic resin material, such as low-density polyethylene, in a softened or molten state to the inner surface of the top panel wall 8 of the shell 4, and allowing a required embossing tool to act on the supplied material for embossing. The liner 6 is caused to adhere all over to the inner surface of the shell 4 owing to the presence of the aforementioned adhesive paint. The liner 6 is in the shape of a disk as a whole, and has a thin-walled central section 22 and a thick-walled peripheral edge section 24. It is important for the thin-walled central section 22, which advantageously has a diameter D3 larger than the inner diameter D1 of the mouth-neck section of the container by a value of the order of 1.0 to 2.5 mm, to have a thickness T1 of 0.15 to 0.30 mm. In order to decrease the required amount of the synthetic resin to reduce the manufacturing cost, it is conceivable to make the thickness of the thin-walled central section 22 as small as possible. If the thickness of the thin-walled central section 22 is set to be excessively small, however, it will become difficult for the synthetic resin material to flow, as required, in embossing the liner 6. Moreover, the allowable error for the descent length of the embossing tool with respect to the inner surface of the shell 2 in forming the liner 6 will become too small, posing considerable difficulty in embossing the liner 6 as required.

It is important for the thick-walled peripheral edge section 24, which advantageously has an outer diameter D4 smaller than the outer diameter D2 of the annular locking ridge in the mouth-neck section of the container by a value of the order of 0.25 to 0.45 mm, to have a thickness T2 of 0.45 to 0.75 mm. If the thickness of the thick-walled peripheral edge section 24 is excessively small, the impact resistance of the container lid 2 (damage to the sealing properties when impact is applied) will be insufficient, as will be understood from the Examples and Comparative Examples to be described later. If the thickness of the thick-walled peripheral edge section 24 is excessively large, on the other hand, the required amount of synthetic resin for formation of the liner 6 will be too large, thus increasing the manufacturing cost. It is important that a downwardly suspending outer ridge 26 be formed in a radially outward region of the thick-walled peripheral edge section 24 of the liner 6. The outer ridge 26 has a cylindrical outer peripheral surface extending substantially vertically, and a truncated conical inner peripheral surface extending downwardly in a radially outwardly inclined manner. Advantageously, the outer ridge 26 protrudes downwardly by a length L1 of 1.00 to 1.40 mm from the lower surface of the thick-walled peripheral edge section 24. If the protruding length of the outer ridge 26 is excessively large, the behavior of the outer ridge 26 becomes unstable when the container lid 2 is fitted on the mouth-neck section of the container to seal the mouth-neck section. As a result, the outer ridge 26 tends to bend radially inwardly, rather than radially outwardly. If the protruding length of the outer ridge 26 is excessively small, the impact resistance of the sealing is insufficient. Furthermore, a force needed when detaching the container lid 2 from the mouth-neck section of the container to unseal the mouth-neck section becomes so low that excessive vibrations are caused to the container, whereby the contents of the container tend to spill. In the illustrated embodiment, a downwardly suspending inner ridge 28 is further formed in a radially inward region of the thick-walled peripheral edge section 24. The inner ridge 28 has a cylindrical inner peripheral surface extending substantially vertically, and an inverted truncated conical outer peripheral surface extending downwardly in a radially inwardly inclined manner. Advantageously, the inner ridge 28 protrudes downwardly by a length L2 of 0.50 to 0.70 mm from the lower surface of the thick-walled peripheral edge section 24.

As will be clearly understood by reference to FIGS. 2 and 3, it is important that the pair of scores 20*a* and 20*b* formed in the shell 4 be arranged radially outwardly of the liner 6, and the second portions 20*a*-2 and 20*b*-2 of the pair of scores 20*a* and 20*b* be extended along and outwardly of the peripheral edge of the liner 6. It is preferred that a gap G between the peripheral edge of the liner 6 and the second portions 20*a*-2, 20*b*-2 of the scores 20*a*, 20*b* be 0.0 to 1.0 mm.

Figure 4:
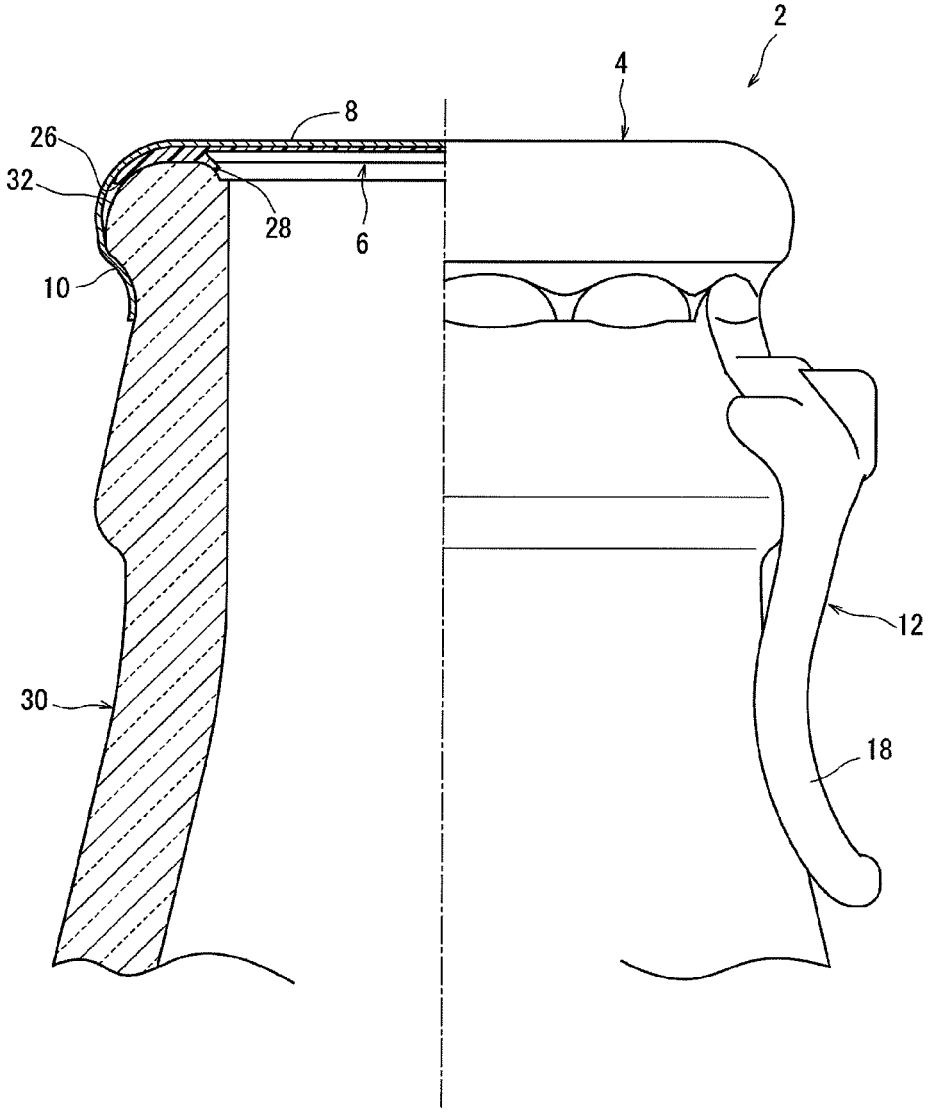
[FIG. 4] is a front view showing, partly in section, a state in which the container lid shown in FIG. 1 is mounted on a mouth-neck section of a container to seal the mouth-neck section.

FIG. 4 illustrates the container lid 2, and a mouth-neck section 30 of the container to be sealed with the container lid 2. The mouth-neck section 30 of the container, which can be formed from glass or a suitable synthetic resin such as polyethylene terephthalate, is nearly cylindrical as a whole, and an annular locking ridge 32 is formed in an upper end part of the outer peripheral surface of the mouth-neck section 30.

In mounting the container lid 2 on the mouth-neck section 30 of the container charged with a gas-containing liquid, such as beer or a carbonated beverage, to seal the mouth-neck section 30, the container lid 2 is fitted on the mouth-neck section 30 and pressed downward. Such a pressing state is maintained to deform the skirt wall 10 of the shell 4 of the container lid 2 radially inwardly. By so doing, a lower part of the skirt wall 10 is locked to the annular locking ridge 32 of the mouth-neck section 30. As will be clearly understood by comparison between and reference to FIG. 2 and FIG. 4, the thick-walled peripheral edge section 24 of the liner 6 is pressed against the top surface of the mouth-neck section 30. The outer ridge 26 is extended radially outwardly along the top surface of the mouth-neck section 30, and extends radially outwardly beyond the second portions 20*a*-2 and 20*b*-2 of the pair of scores 20*a* and 20*b* formed at the upper end of the skirt wall 10 of the shell 2. The inner ridge 28 is extended radially inwardly along the top surface of the mouth-neck section 30.

In detaching the container lid 2 from the mouth-neck section 30 to unseal the mouth-neck section 30 in order to consume the contents of the container, a finger is hooked on the ring-shaped section 18 in the gripping piece 12 of the shell 4, and the gripping piece 12 is forced radially outwardly and then upwardly or diametrically oppositely, thereby breaking the pair of scores 20*a* and 20*b* formed in the shell 2. In this manner, the locking of the lower part of the skirt wall 10 of the shell 2 to the annular locking ridge 32 of the mouth-neck section 30 is released to remove the container lid 2 from the mouth-neck section 30. During this action, the outer peripheral edge section of the liner 4 extending radially outwardly beyond the second portion 20*a*-2 and 20*b*-2 of the pair of scores 20*a* and 20*b* is displaced radially inwardly and upwardly with respect to the pair of scores 20*a* and 20*b* in the shell 2. In association with this motion, the part outside the second portions 20*a*-2 and 20*b*-2 of the pair of scores 20*a* and 20*b* in the shell 2 is urged radially outwardly to help release the locking of the lower part of the skirt wall 10 of the shell 4 to the annular locking ridge 32 of the mouth-neck section 30.

EXAMPLE 1

Ten shells of a shape as shown in FIGS. 1 and 2 were formed from a 0.18 mm thick aluminum-based alloy sheet coated on one surface (a surface corresponding to the inner surface of the shell) with a polyester-based paint containing acid-modified polyethylene. Then, low-density polyethylene (density 0.91) in a softened or molten state was supplied to the top panel wall of each of the shells, and embossed to form a liner as shown in FIGS. 2 and 3. The thickness Ti of the thin-walled central section of the liner was 0.20 mm, the thickness T2 of the thick-walled peripheral edge section of the liner was 0.60 mm, the diameter D3 of the thin-walled central section was 19.0 mm, the outer diameter D4 of the thick-walled peripheral edge section was 23.5 mm, the protruding length L1 of the outer ridge from the lower surface of the thick-walled peripheral edge section was 1.20 mm, and the protruding length L2 of the inner ridge from the lower surface of the thick-walled peripheral edge section was 0.7 mm. The gap G between the outer peripheral edge of the liner and the second portion of the scores was 0.2 to 0.3 mm.

Ten glass containers (nominal volume 520 ml) each having the mouth-neck section illustrated in FIG. 4 were each charged with 480 ml of beer, and then the aforementioned container lid was mounted on the mouth-neck section to seal the mouth-neck section. After the 10 containers each filled with beer and mounted with the container lid were each allowed to stand for 24 hours in an environment of 23° C., an impact resistance test was performed. In such an impact resistance test, the container was brought into an inverted state, and dropped from a height of 20 cm onto an inclined steel plate having a thickness of 50 mm and an inclination angle of 20 degrees. Then, the presence or absence of staining of a water reaction paper covering the container lid was confirmed to evaluate whether leakage of beer occurred or not. The results are as described in Table 1 to be offered below.

EXAMPLE 2

An impact resistance test was performed in the same manner as in Example 1, except that the thickness of the thick-walled peripheral edge section of the liner was 0.45 mm. The results are as shown in Table 1.

EXAMPLE 3

An impact resistance test was performed in the same manner as in Example 1, except that the thickness of the thin-walled central section of the liner was 0.15 mm. The results are as shown in Table 1.

COMPARATIVE EXAMPLE 1

An impact resistance test was performed in the same manner as in Example 1, except that the thickness of the thick-walled peripheral edge section of the liner was 0.40 mm. The results are as shown in Table 1.

COMPARATIVE EXAMPLE 2

Ten container lids were produced in the same manner as in Example 1, except that the thickness of the thin-walled central section of the liner was 0.10 mm. The state of the formed liner was tested, showing that failures in liner formation due to unsatisfactory fluidity of the synthetic resin material were observed in all the container lids.

TABLE 1

| | Ex. 1 | Ex. 2 | Ex. 3 | Comp. Ex. 1 | Comp. Ex. 2 |
|---|---|---|---|---|---|
| Thickness T1 of thin-walled central section (mm) | 0.20 | 0.20 | 0.15 | 0.20 | 0.10 |
| Thickness T2 of thick-walled peripheral edge section (mm) | 0.60 | 0.45 | 0.60 | 0.40 | 0.60 |
| Impact resistance test (No. with leakage/ No. tested) | 0/10 | 0/10 | 0/10 | 2/10 | |
| Liner formability | ○ | ○ | ○ | ○ | X |

EXPLANATIONS OF LETTERS OR NUMERALS

2: Container lid
4: Shell
6: Liner
8: Top panel wall
10: Skirt wall
12: Gripping piece
14: Base of gripping piece
20*a*: Score
20*b*: Score
20*a*-1: First portion of score
20*b*-1: First portion of score
20*a*-2: Second portion of score
20*b*-2: Second portion of score
22: Thin-walled centration section of liner
24: Thick-walled peripheral edge section of liner
26: Outer ridge
28: Inner ridge
30: Mouth-neck section of container
32: Annular locking ridge

The invention claimed is:

1. An easily openable container lid for a container having a cylindrical mouth-neck section having an annular locking ridge formed in an upper end part of an outer peripheral surface thereof, comprising:

a shell including a circular top panel wall, a skirt wall extending from a peripheral edge of the top panel wall arcuately in a radially outward and downward direction and then extending downwardly vertically, in a vertical sectional view, and a gripping piece extending out from a lower end of the skirt wall, wherein the top panel wall, the skirt wall, and at least a base of the gripping piece are integrally formed from a metallic sheet, and the shell is formed with a pair of scores having first portions extending upwardly on the skirt wall from both sides of the gripping piece, and second portions continuous with the first portions and extending arcuately at an upper end of the skirt wall or the peripheral edge of the top panel wall; and a disk-shaped synthetic resin liner formed by embossing a synthetic resin material on an inner surface of the top panel wall of the shell, wherein the liner is adhered over an entire surface thereof to the inner surface of the top panel wall, at least the second portions of the pair of scores are formed by forming grooves on an inner surface side of the shell, and are extended along a peripheral edge of the liner radially outwardly of the liner, and the liner has a thin-walled central section and a thick-walled peripheral edge section, and has a downwardly protruding outer ridge formed in a radially outward region of the thick-walled peripheral edge section, the thin-walled central section of the liner has a thickness of 0.15 to 0.30 mm, and the thick-walled peripheral edge section has a thickness of 0.45 to 0.75 mm.

2. The easily openable container lid according to claim 1, wherein the outer ridge protrudes 1.00 to 1.40 mm from a lower surface of the thick-walled peripheral edge section.

3. The easily openable container lid according to claim 1, wherein a downwardly protruding inner ridge is formed in a radially inward region of the thick-walled peripheral edge section of the liner.

4. The easily openable container lid according to claim 3, wherein the inner ridge protrudes 0.50 to 0.70 mm from a lower surface of the thick-walled peripheral edge section.

5. The easily openable container lid according to claim 1, wherein a gas-containing liquid is accommodated within the container, an interior of the container is brought to a positive pressure after the easily openable container lid is mounted on the mouth-neck section of the container to seal the mouth-neck section, and the top panel wall of the shell is flat.

6. The easily openable container lid according to claim 1, wherein the top panel wall, the skirt wall, and at least the base of the gripping piece, of the shell are formed from an aluminum-based alloy sheet having a thickness of 0.17 to 0.19 mm, a residual thickness of a breakage starting end section of the first portions of the pair of scores is 150 to 170 μm, a residual thickness of a remainder of the first portions is 135 to 155 μm, and a residual thickness of the second portions is 105 to 125 μm.

* * * * *